US006497606B2

(12) United States Patent
Fong et al.

(10) Patent No.: US 6,497,606 B2
(45) Date of Patent: Dec. 24, 2002

(54) INTERACTIVE TALKING DOLLS

(76) Inventors: Peter Sui Lun Fong, Kowloon (HK); Chi Fai Mak, Kowloon (HK)

( * ) Notice: Subject to any disclaimer, the term of this patent is extended or adjusted under 35 U.S.C. 154(b) by 0 days.

(21) Appl. No.: 10/008,879

(22) Filed: Nov. 8, 2001

(65) Prior Publication Data

US 2002/0052163 A1 May 2, 2002

Related U.S. Application Data

(63) Continuation of application No. 09/883,762, filed on Jun. 18, 2001, which is a continuation of application No. 09/685,527, filed on Oct. 10, 2000, now Pat. No. 6,309,275, which is a continuation of application No. 08/831,635, filed on Apr. 9, 1997, now abandoned.

(51) Int. Cl.[7] ..... A63H 3/28
(52) U.S. Cl. ..... 446/297; 446/175
(58) Field of Search ..... 369/31, 63–67; 434/308, 319–322, 397; 446/175, 268, 297–303, 397

(56) References Cited

U.S. PATENT DOCUMENTS

| | | | | |
|---|---|---|---|---|
| 3,739,521 A | 6/1973 | Fox | | |
| 3,796,284 A | 3/1974 | Zeigner et al. | | |
| 4,654,659 A | 3/1987 | Kubo | | |
| 4,840,602 A | 6/1989 | Rose | 446/175 | |
| 4,857,030 A | 8/1989 | Rose | 446/303 | |
| 4,878,871 A | 11/1989 | Noto | 446/302 | |
| 4,923,428 A | 5/1990 | Curran | 446/175 | |
| 5,209,695 A | 5/1993 | Rothschild | 446/175 | |
| 5,281,143 A | 1/1994 | Arad et al. | 434/185 | |
| 5,281,180 A | 1/1994 | Lam et al. | 446/175 | |
| 5,328,401 A | 7/1994 | DeMars | 446/295 | |
| 5,376,038 A | 12/1994 | Arad et al. | 446/297 | |
| 5,636,994 A | 6/1997 | Tong | 434/308 | |
| 5,746,602 A | 5/1998 | Kikinis | 434/169 | |
| 5,752,880 A | 5/1998 | Gabai et al. | | |
| 6,089,942 A | 7/2000 | Chan | 446/175 | |
| 6,110,000 A | 8/2000 | Ting | 446/302 | |

FOREIGN PATENT DOCUMENTS

GB 2060416 A 5/1981

*Primary Examiner*—John A. Ricci
(74) *Attorney, Agent, or Firm*—Stetina Brunda Garred & Brucker

(57) ABSTRACT

A set of interactive toys that perform a sequence of actions in response to one another without external activation other than an initial actuation to begin the sequence of actions. Preferably, each toy has an activation switch and/or a receiver for a wireless signal such as an infrared signal which activates the toy. Upon activation, the toy performs a desired action, such as the enunciation of a speech pattern, and signals another toy to perform a responsive action. Preferably, the toy are capable of performing several different action sequences, such as the enunciation of different conversations, the performance of different movements, etc. Additionally, the toys are programmable by a remote control device. The remote control device either functions as an activation switch, initiating a random or predetermined (yet not user determined) sequence of interactions, or as an interaction selector, such that a desired sequence of actions may be selected.

35 Claims, 11 Drawing Sheets

| J1 | J2 | J3 | J4 | J5 | FUNCTION | |
|---|---|---|---|---|---|---|
| CONNECT | OPEN | OPEN | OPEN | OPEN | OPTION 1 WITH QUESTIONS IN SEQUENCE | 120 |
| CONNECT | OPEN | CONNECT | OPEN | OPEN | OPTION 1 WITH QUESTIONS IN RANDOM | 122 |
| CONNECT | CONNECT | OPEN | OPEN | OPEN | OPTION 1 FOR MAGIC PIANO/FLUTE | 124 |
| OPEN | OPEN | OPEN | OPEN | OPEN | OPTION 2 WITH QUESTIONS IN SEQUENCE | 126 |
| OPEN | OPEN | CONNECT | OPEN | OPEN | OPTION 2 WITH QUESTIONS IN RANDOM | 128 |
| OPEN | OPEN | OPEN | CONNECT | OPEN | OPTION 3 WITH QUESTIONS IN SEQUENCE | 130 |
| OPEN | OPEN | CONNECT | CONNECT | OPEN | OPTION 3 WITH QUESTIONS IN RANDOM | 132 |
| OPEN | OPEN | OPEN | OPEN | CONNECT | OPTION 4 WITH QUESTIONS IN SEQUENCE | 134 |
| OPEN | OPEN | CONNECT | OPEN | CONNECT | OPTION 4 WITH QUESTIONS IN RANDOM | 136 |
| OPEN | OPEN | OPEN | CONNECT | CONNECT | OPTION 5 WITH QUESTIONS IN SEQUENCE | 138 |
| OPEN | OPEN | CONNECT | CONNECT | CONNECT | OPTION 5 WITH QUESTIONS IN RANDOM | 140 |

Fig. 4

INTERACTIVE TALKING DOLLS

RELATED APPLICATIONS

The present application is a continuation of U.S. application Ser. No. 09/883,762 entitled INTERACTIVE TALKING DOLLS filed Jun. 18, 2001, which is a continuation of U.S. application Ser. No. 09/685,527 entitled INTERACTIVE TALKING DOLLS filed Oct. 10, 2000, now U.S. Pat. No. 6,309,275, which is a continuation of U.S. application Ser. No. 08/831,635 entitled INTERACTIVE TALKING DOLLS filed Apr. 9, 1997 now abandoned.

BACKGROUND OF THE INVENTION

The present invention relates to interactive toys, one toy, once activated by a user, activating another toy. More particularly, the present invention relates to a pair of toys which perform responsive actions or functions in continuous sequence. In a preferred embodiment a set of talking dolls are provided. The user activates one of the dolls to say a sentence. At the end of the sentence, the user-activated doll activates another doll to respond to the first sentence. Each doll may respond to the sentence of another doll until a conversation is complete.

Toys that are activated by a user to perform a desired function are known in the art. For example, a variety of dolls exist that perform a desired action, such as speaking or moving, when activated by a user. However, the doll typically only performs a single action (e.g., the doll says a single word or phrase, or moves in a desired manner) without saying anything more until the activation switch is pressed again. Thus, although several activation switches may be provided, each switch causing the doll to performed a desired action (e.g., say a specific word or phrase or move in a desired manner) associated with that switch, once the action is completed, the doll is idle. Only when the desired activation switch is pressed does the doll perform again. Such dolls need not be activated by a mechanically activated switch. Light-sensitive switches may be used instead of, or in addition to, a mechanical switch, such as shown in U.S. Pat. No. 5,281,180 to Lam et al.

The desired action need not be the enunciation of a speech pattern. Other toys are known that perform another action, such as moving or flashing lights, upon activation by the user. However, the above-described toys merely perform the single desired action or function in response to activation by a user. These toys do not then activate another device without further intervention from a user.

Despite the variety of known means for activating the toy to perform a desired action and the variety of actions that may be performed, none of the known toys causes another toy to respond with an action which may then cause the first activated toy (or yet another toy) to perform yet another, further-responsive action (again, without further intervention by a user). Until now, the device used to activate another device has comprised a signal generator alone, such as a remote control unit, that does not perform an action (such as enunciation of a speech pattern) other than transmitting a signal. Thus, in effect, the only "toy" that is activated to perform a desired function is the toy controlled by the remote control device, the remote control device not performing an independent action. The toy which performs the desired action is not activated by another device that has performed a desired action. Moreover, a set of interactive toys which each perform a desired action in addition to transmitting a signal to another toy has not yet been provided with the capability of being programmed by an external, wireless control device such as a common household remote control unit which merely signals one of the toys to perform a desired action, that action then triggering a cascade of mutual activation and response.

SUMMARY OF THE INVENTION

It is therefore an object of the present invention to provide a toy that performs a desired action upon user activation, the action accompanied by a signal to another toy to perform a responsive action without further intervention by the user.

It is a related object of the present invention to provide a set of toys which interactively cause each other to perform a desired action, each action accompanied by a signal to the other toy to perform a responsive action.

It is another object of the present invention to provide a set of responsive toys that are programmable and controllable by a household remote control device which generates a control signal to activate one of the toys.

These and other objects of the present invention are accomplished in accordance with the principles of the present invention by providing a set of interactive toys. Each toy performs an action, the action of at least one of the toys being accompanied by a signal that is sent to the other toy to cause the other toy to perform a responsive action. Preferably, the other toy's action is also accompanied by a signal that is sent to the first toy (or, yet another toy) to pause that toy to perform yet another (the same or different) responsive action. Although only a single interactive responsive action sequence may be performed by the toys, preferably, the set of toys performs one of a variety of different interactive responsive action sequences. The user may either select the action sequence to be performed, or the action may be selected randomly or in a given sequence by the control system of the toy, for example, upon activation of one of the toys. Each toy may respond with a single set response. However, most preferably, each toy may respond in one of several manners, randomly, sequentially, or user-selected, to the action of the other toy.

Because the response of the other toy should be consonant with the action of the user-activated toy, the user-activated toy typically sends a signal to the other (receiving) toy that is coded. The code is received by the receiving toy to cause the receiving toy to perform an appropriate action in response to the action previously performed by the first signal-emitting toy in the sequence. This interaction may continue until the logical conclusion of the interaction or indefinitely. For example, if the actions are the enunciation of a word or phrase, the interaction is a conversation which ends at the logical conclusion of the conversation. In a preferred embodiment, the toys are dolls and the interaction is in the form of a conversation comprising responsive speech patterns enunciated by the dolls. However, the toys may comprise animals, or a doll interacting with another object, such as a car.

Also in accordance with the principles of the present invention, the toys can be controlled by a household remote control device. Thus, the toys may be initially activated wirelessly such that a hard-wired switch on the toy is not necessary. Additionally, each toy preferably is also programmable to respond to signals of the remote control device in a desired manner. Specifically, if several interactive action sequences may be performed, then each interactive action sequence and/or each individual response may be associated with a button on the remote control device. Additionally, another button on the remote control device is preferably dedicated to remote random selection of an interactive sequence/response.

BRIEF DESCRIPTION OF THE DRAWINGS

These and other features and advantages of the present invention will be readily apparent from the following detailed description of the invention, the scope of the invention being set out in the appended claims. The detailed description will be better understood in conjunction with the accompanying drawings, wherein like reference characters represent like elements, as follows:

FIG. 4 is a table showing jumper connections for setting the options setting of the interactive mechanism of the present invention;

DETAILED DESCRIPTION OF THE INVENTION

In accordance with the principles of the present invention, a set of toys are provided for interacting with one another independently of user input other than an initial activation of one member of the set to commence interaction. A first toy is actuated to perform a first desired action. Actuation may either be caused by actuation of a hard-wired activation switch or by transmission of a wireless signal, such as a signal from a remote control unit. Upon completion of the desired action, the first toy activates a second toy to perform a second desired action, typically in response to the first desired action. In the simplest form of the invention, once the second toy completes the second desired responsive action, the action sequence is complete, acid the toys remain inactive. However, if desired, the second toy may perform a thud desired action, such as a reaction-inducing action, after completing the second desired action. Upon completion of the third (reaction-inducing) action, the second toy activates either the first toy or yet another toy to react to the reaction-inducing action. The first (or the yet other toy) then responds to the third (reaction-inducing) action with a fourth desired action. Such interaction between the toys may continue for a set number of rounds, or indefinitely, as desired.

Figure 1:
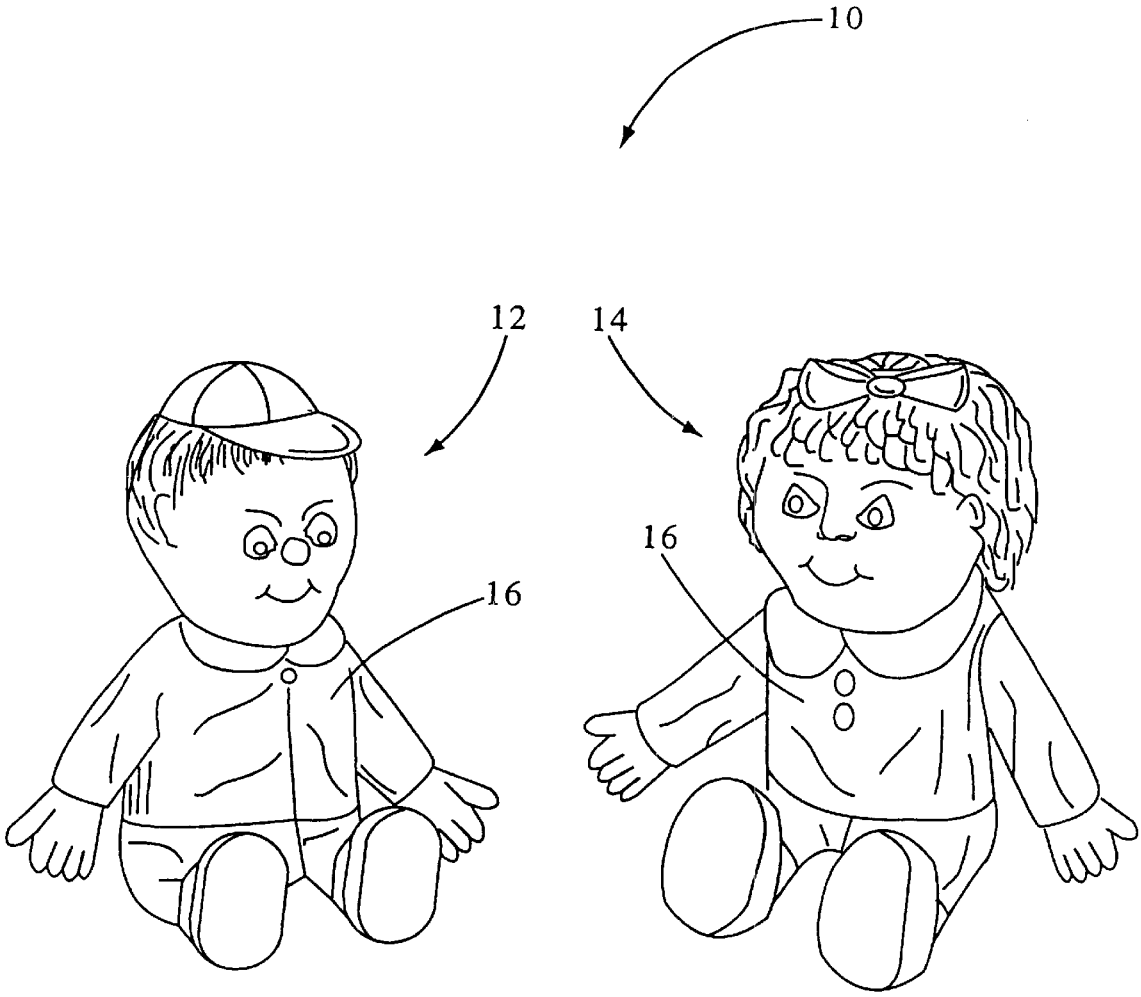
FIG. 1 is a perspective view of a set of exemplary toys that may be used to perform a sequence of interactive actions in accordance with the principles of the present invention.
Figure 1A:
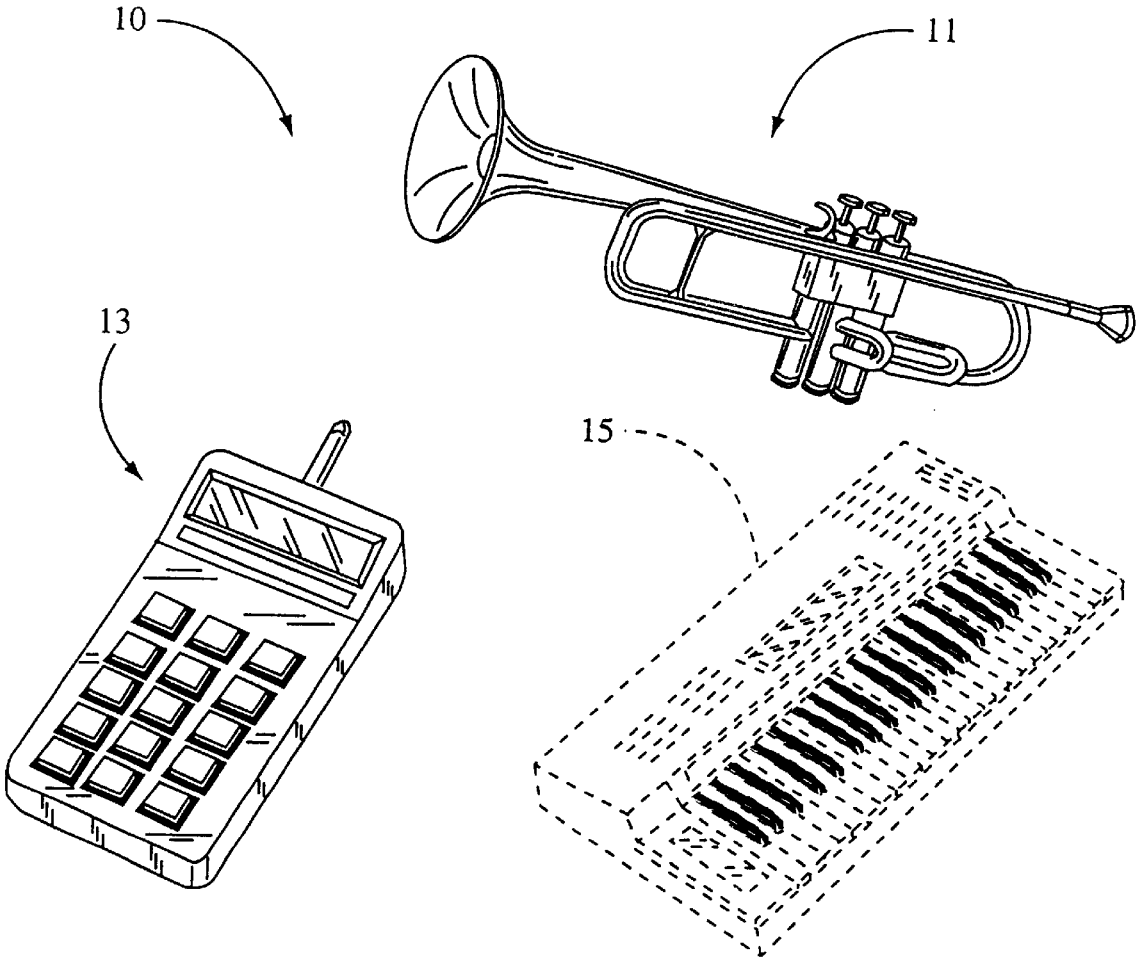

In a preferred embodiment, interactive toys 10 are in the form of a first doll 12 and a second doll 14, as shown in FIG. 1. However, the interactive toys need not be dolls and one toy need not be the same as the other. For example, a combination of a doll and an animal (such as a dog that barks in response to question asked by the doll), or a doll and an inanimate object (such as a car that opens its doors or turns on its headlights or starts its engine), two animals, or two inanimate objects (such as two musical instruments each playing a musical piece), or a variety of desired objects that may interact with each other in an amusing manner are all within the scope of this invention. One such example of interactive toys is a sound producing element that emits a sound sequence (such as a musical piece) and a keyboard (or other such device with activation keys) that actuates the sound producing element. The keyboard emits a tone (or a sound or a message indicating the action to be performed by the sound producing element) before actuating the sound producing element to play the desired sound sequence. Once the sound sequence has been performed, the sound producing element signals the keyboard to activate the same or a different sound producing element (or another type of toy), which element or toy then performs another desired action.

In the case of dolls 12, 14, each doll has a body 16 in which the mechanism that controls the interactive action sequence is housed. Although body 16 preferably is soft, body 16 may be formed from any desired material that permits transmission of wireless signals, such as infrared signals, therethrough. The same is true of the housings or bodies of the other toy fortes that may be used instead of dolls 12, 14.

Figure 2:
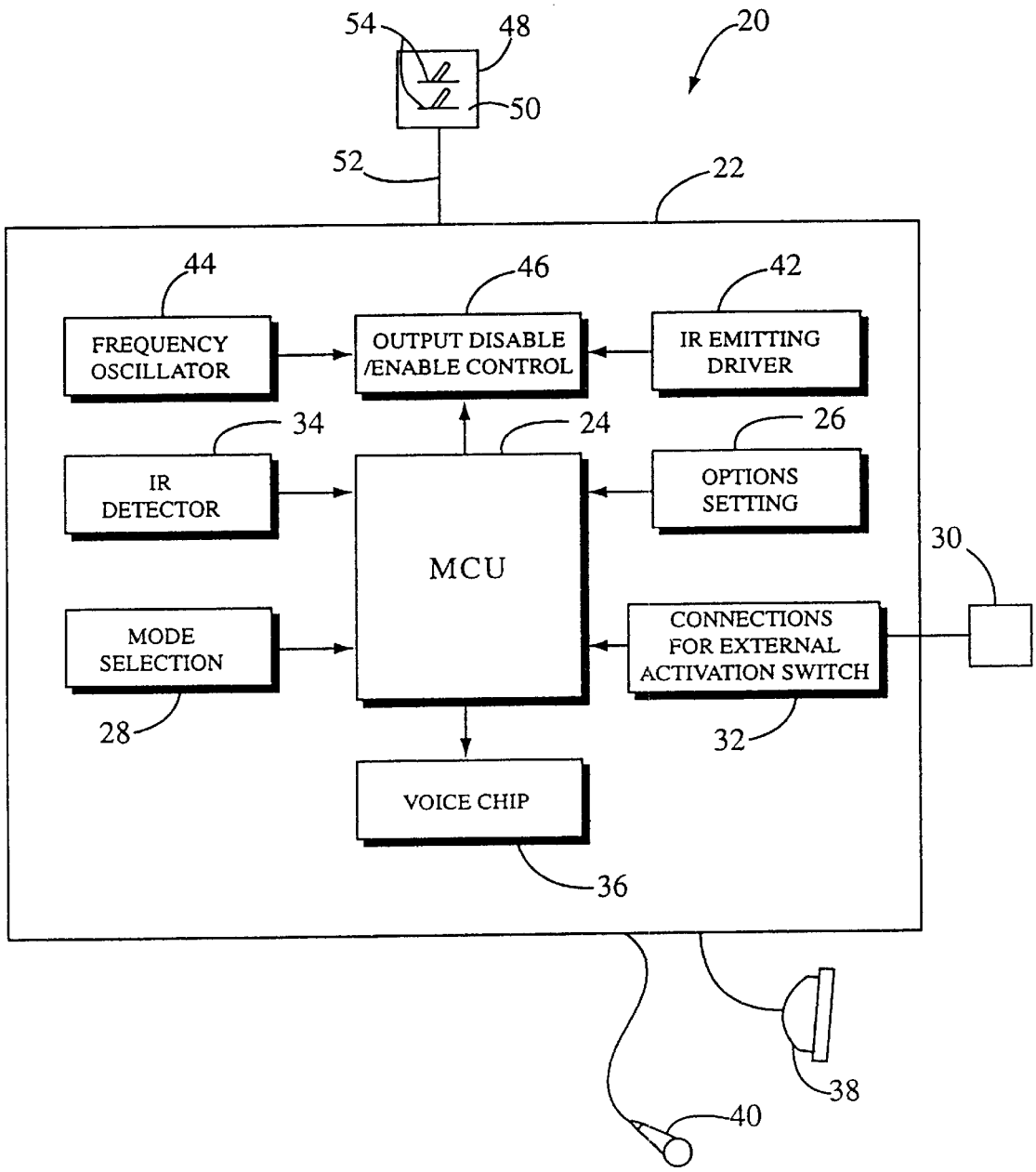
FIG. 2 is a high level block diagram of the interactive mechanism of a set of toys in accordance with the principles of the present invention.

Each set of toys provided in accordance with the principles of the present invention has a mechanism 20 that permits and implements performance of the interactive action sequence (hereinafter "the interactive mechanism") as shown in FIG. 2. Interactive mechanism 20 of each toy comprises a number of functional blocks that permit each toy to receive an activation signal, and, in response, to cause that toy to perform a desired action. Upon completion of that action, the appropriate functional blocks of interactive mechanism 20 cause another toy to perform a desired responsive action (if a response is called for). Preferably, the other toy is also capable of activating either the first-activated toy, or yet another toy, to perform yet another responsive action. Thus, interactive mechanism 20 causes the toys to perform a sequence of interactive actions.

The components of interactive mechanism 20 include a program control box 22 containing the necessary components for controlling the interactive sequence of events. Preferably the components of program control box 22 are contained within a housing within the toy. Program control box 22 includes a microcontroller unit ("MCU") 24 that receives and processes information to control the functioning of interactive mechanism 20. Preferably, MCU 24 initially reads the option set by options setting 26 to determine the duration of the interaction to be performed by the interactive toys and whether actuation of the toy is to cause random selection of an action to be performed or sequential selection of an action, the possible actions thus being performed in a preset, predetermined linear order. For example, each toy may only perform a single action, or, the second toy may cause another toy (or the first acting toy) to perform another responsive action (such that three actions are performed). The interactive sequence may continue between two or more toys for a predetermined finite number of interactions or indefinitely. The MCU also must read the mode selected by mode selection 28. Mode selection 28 determines whether interactive mechanism 20 is in a play mode, in which the toys are enabled to perform the interactive actions, or in a learn mode, in which the toys may be programmed, as will be described in further detail below.

MCU 24 remains in a sleep mode, which reduces power consumption, until it receives an activation signal from mode selection 28, or from external hard-wired activation switch 30 via switch connections 32, or from infrared ("IR") detector/receiver 34 (or another receiver for a wireless activation signal) to commence operation. External activation switch 30 may take on any desired form known in the art, activated by any of a variety of external stimuli such as touch, light, sound (e.g., a voice recognition switch), motion (either motion of the switch itself or detection of an external motion), magnetic forces, etc. If desired, a separate activation switch may be provided for each of the possible actions to be performed (or at least for the initial action) so that the user may select the interactive sequence of actions to be performed. However, in order to reduce manufacturing costs, a single activation switch may be provided, causing MCU 24 to select (either randomly or sequentially, depending on the setting of options setting 26) the interactive sequence of actions to be performed. It will be understood that any other type of receiver for receiving a wireless signal from another toy of the set may be used instead of an IR receiver, depending on the type of wireless signals transmitted between the toys of the present invention. Although IR detector/receiver 34 is shown as part of program control box 22, it will be understood that IR detector/receiver 34 may, instead, be externally coupled to program control box 22.

If an activation signal is received from mode selection 28, then the learning subroutine, which permits programming of the toys with a remote control unit, is commenced, as described in l further detail below. If, instead, an activation signal is received via switch connections 32 from external activation switch 30, or via IR detector 34, then MCU 24 will begin the desired program encoded therein to commence the desired interactive operation. Thus, an action performing device must be provided to carry out the desired action of the interactive sequence of actions.

In a preferred embodiment, as mentioned above, at least two dolls 14, 16, are provided as the toys that are to interact. Thus, one form of an action performing devices may be a voice chip 36, such as those known in the art, that has at least one and preferably several speech patterns stored therein which arc enunciated upon activation of the voice chip by MCU 24 as the desired action to be performed. If desired, the voice chip not only contains a series of recorded phrases ("speech patterns") stored in a memory (preferably a ROM provided therein), but also has recording capability such that the user may record desired speech patterns thereon. If another action is to be performed instead, then the necessary component for performing that desired action is provided in addition to or instead of voice chip 36. As will be understood, the exact form of the action performing device depends on the design choices in implementing the principles of the present invention, the present invention thus not being limited to the use of a voice chip. Far example, a motor that moves a part of the interactive toy (e.g., for activating an arm to wave, or for moving the lips of the doll), lights that selectively flash, or other desired devices that can perform an action that is responsive to an action performed by another toy, such other action performing device also being well known in the art, may be provided instead of or in addition to a voice chip. Thus, if the toys are not dolls, but instead are inanimate objects, then the accessory mechanism that must be provided for causing the toy to perform a desired action would not be a voice chip. For instance, the set of toys may be an activation keyboard that emits a tone (or other sound or message) and a sound producing element that plays music (e.g., a musical instrument, such as a piano or a flute). The action performing device thus is not necessarily a voice chip but may be any electronic or mechanical component known in the art for causing the production of such non-vocal sounds. Likewise, if the toys are a doll and a car, then the action producing devices would include not only a voice chip for the doll, but also a device that can control elements of the car (such as a motor or a headlight) that are to be actuated by the doll.

If the action performing device is a voice chip 36, then a speaker 38 is included as part of interactive mechanism 10, electrically coupled to the components of program control box 22 (preferably electrically coupled to the voice chip) as will be described in greater detail below. If recording capability is desired, then a microphone 40 is also included in interactive mechanism 20, electrically coupled to the components of program control box 22. Similarly, any other element that performs the desired action and which is associated with the device that causes the action to be performed is coupled to program control box 22.

Although the interactive toys used in the present invention may be electrically coupled together to transmit signals to each other, preferably, the interactive toys are provided with transmitters and receivers for wirelessly transferring signals between each other. Various means for wirelessly communicating information between inanimate objects, such as electrical equipment, are known in the art. Typically, information is transferred via audible sound, ultrasound, radio frequency, and infrared wave signals. In the preferred embodiment of the present invention, infrared signals are transmitted between the toys. Thus, FCC approval, which would be needed for other transmission media such as radio frequency, is not necessary. It will be understood that any other desired signal transmitting and detecting/receiving components which wirelessly exchange information may be used instead.

Preferably, an infrared ("IR") emitting driver 42 (such as an infrared light emitting diode), or other such infrared signal emitter, is coupled to the other components of program control box 22. If the IR detectors used in the interactive toys are the type that only can receive an oscillating signal, such as is common in the art, IR emitting driver 42 must be driven to emit an oscillating signal. Thus frequency oscillator 44 is coupled to IR emitting driver 42 through an output disable/enable control 46. Output control 46 is normally set so that oscillating signals are not sent from oscillator 44 to IR emitting driver 42. However, once an action has been performed and interactive mechanism 20 is to activate another interactive mechanism 20 of a corresponding interactive toy, output control 46 enables oscillator 44 to send the desired signal to IR emitting driver 42. A signal thus is emitted from IR emitting driver 42 which may be received by an IR detector of a corresponding interactive toy having a control mechanism substantially identical to interactive control mechanism 20.

A power and control box 48 provides program control box 22, as well as the other devices comprising interactive mechanism 20, with power. Typically, power and control box 48 comprises a battery pack within a housing 50 and the requisite wiring 52 coupling the battery pack to at least program control box 22. Program control box 22 then supplies the remaining components of interactive mechanism 20 with power. However, if desired, power and control box 48 may be separately coupled to each of the remaining components of interactive mechanism 20, instead. Access to power and control box 48 is generally provided so that the batteries therein can be replaced as necessary.

Because power and control box 48 is typically the only component of interactive mechanism 20 that is user-accessible, power and control box 48 may be provided with control switches 54 which provide overall control of interactive mechanism 20. Control switches 54 may include an on/off switch 55 for turning the toy on so that power is not expended when the toy is not in use. Additionally, control switches 54 may include a mode selection switch (coupled to and enabling mode selection 28) for selecting whether the toy is in "play" mode or in "learn" mode, as will be described in further detail below.

Figure 3:
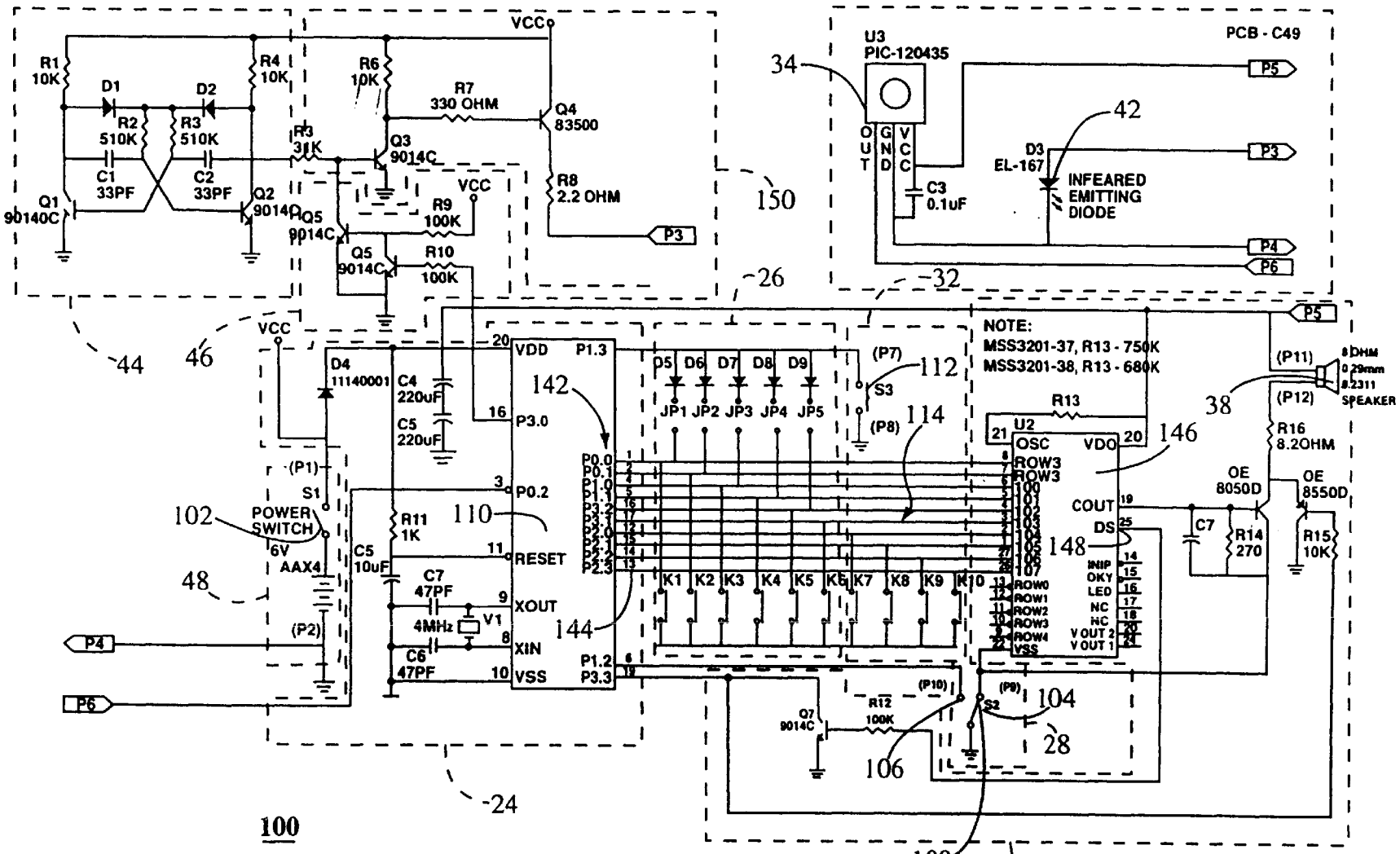
FIG. 3 is a detailed circuit diagram of the circuitry of FIG. 2 for implementing an interactive sequence according to the present invention.

A detailed circuit diagram showing a preferred circuit 100 containing the components making up the above-described functional blocks is shown in FIG. 3. Blocked sections of the diagram of FIG. 3 representing a functional block of FIG. 2 are represented by the same reference numeral. It will be understood that power switch 102 (of power control block 55) must be closed in order for circuit 100 to function. Furthermore, the function performed by circuit 100 is determined by mode selection block 28 comprising mode selection switch 104 positionable between a learn position 146 and a play position 108. The function of circuit 100 will first be described for the mode in which mode selection switch 104 is in the play position 108.

Circuit 100 is controlled by MCU 34 comprising microcontroller 110. Microcontroller 110 preferably is a 4-bit high performance single-chip microcontroller having a sufficient number of input/output ports to correspond to the number of desired actions that the toy is to perform, a timer (preferably an 8-bit basic timer) for measuring the time interval of an incoming signal (preferably an IR signal), and sufficient memory (RAM and ROM) to store the required software for causing circuit 100 to implement the desired interactive sequence of actions as well as to score the desired number of remote control codes for circuit programming with a remote control unit, as will be described below. A more powerful microprocessor, such as an 8-bit microprocessor, may be used instead, depending on design choices. Because the signals between the toys are preferably wireless; and, most preferably infrared signals, the microcontroller must be selected to have sufficient speed to generate a signal that can activate an infrared transmitter, as well as to recognize a received infrared signal. The size of the ROM/RAM, the power requirements, and the number of input and output pins are determined by the particular design requirements of the toys. A preferred microcontroller unit is the KS57C0302 CMOS microcontroller sold by Samsung Electronics of Korea.

In a preferred embodiment, at least ten input/output ports are provided so that the toy can perform at least five initiating actions and five responsive actions. However, it will be understood that because the number of input/output ports corresponds to the number of actions which may be performed, fewer or greater than ten input/output ports may be provided depending on design choices. Thus, each microcontroller 110 preferably has six (6) pairs of input/output pins five (5) of which are dedicated to random/sequential selection of an action (i.e., non-user determined selection of an action to be performed, the MCU 24 determining which action is to be performed based on the setting of options setting 26). Of course, in the simplest form of the invention (in which a first toy performs an action and then activates a second toy to perform a responsive action, the action sequence ending upon completion of the responsive action) only a single input/output port is necessary.

With circuit 100 supplied with power via power switch 102, microcontroller 110 preferably remains in a sleep mode until one of three activation signals is received: a signal from hard-wired switch connections 32 (from an external activation switch); a wireless signal, such as from infrared detector/receiver 34; or a signal from mode selection block 28. The first two mentioned signals activate circuit 100 when mode selection switch 104 is in the play position 108. The third-mentioned signal activates circuit 100 when mode selection switch 104 is in the learn position 106 for programming purposes, and thus will be described in further detail below.

Switch connections 32 may be coupled to a switch 30 located on or near the toy (such as in body 18 of doll 12, 14) or a key 114 of a keyboard coupled to circuit 100. Infrared detector/receiver 34 receives a signal either from an infrared emitting diode, similar to IR emitting driver 42 of circuit 100, of a circuit (substantially identical to circuit 100) in an associated toy or from a remote control device (such as a household television remote controller) which can generate infrared signals. Use of a remote control device for activating the toy of the present invention will be described in greater detail below.

Receipt by MCU 24 of an activation signal from switch connections 32 causes MCU 24 to select a desired action to be performed. The desired action may be selected by a user (e.g., by pressing a desired activation switch associated with the desired action to be performed if a switch corresponding to each action is provided), or, by the MCU. If an activation switch is provided for MCU selection of the interactive sequence of actions to be performed, performance of the action may be in a preset linear order (i.e., in a set sequence), or at random, depending on the setting of options setting 26.

Options setting 26 is set through the use of jumpers J1–J5 diodes D5–D9 to close the jumpers. The jumper settings may either be hard-wired, or user selected via a dip switch having the required number of setting levers. A table showing various jumper connections, providing various settings 120–140, and their associated functions is shown in FIG. 4. As can be seen, each function may be performed in either a linear sequence ("in sequence"), in which the actions that are performed follow a set order, or in a random order ("in random"), in which the actions are performed in a random order. Setting 120 causes MCU 24 to perform option 1, representing the performance of one of a variety of desired actions by a toy, in a linear sequence. Setting 122, on the other hand, causes MCU 24 to perform option 1 in a random order. Setting 124 causes MCU 24 to perform option 1 as controlled by a preferably musical toy such as a piano or a flute. Setting 126 causes MCU 24 to perform option 2, in which the first toy performs a response-inducing action and the second toy performs a responsive action, in sequence, whereas setting 123 causes MCU 24 to perform option 2 to be performed in random order. Option 3, in which each toy performs a response-inducing action as well as a responsive action (i.e., the first toy performs a first action, the second toy responds to that action and then performs another action to which the first toy, or another toy, responds), is performed in sequence by setting 130 and in random by setting 132. Option 4, in which each toy performs greater than two (preferably ten) response-inducing actions as well as greater than two (preferably ten) responsive actions, is performed in sequence by setting 134 and in random by setting 136. Finally, endless interactive actions are performed in option 5, either in sequence by setting 138, or in random by setting 140.

Whatever the desired action is, MCU 24 is actuated by an activation signal to perform the appropriate subroutine for performing the desired interactive sequence of actions, as described in greater detail below. Each action is associated with a corresponding code by the software subroutine initialized by the actuation of the toy, the subroutine sending the appropriate signal to the appropriate device to perform the desired action corresponding to the signal. The requisite code for initiating the action is preferably contained in a look up table (which is part of the software program) containing a list of the codes corresponding to-the desired actions that may be performed. Once the code for the desired action to be performed is determined, the appropriate one or more of input/output pins 142 of microprocessor 110 is activated in a manner familiar to those skilled in the art.

In a preferred embodiment, the desired action is the enunciation of a speech pattern. Thus, data output bus 144 couples MCU 24 with voice chip block 36 containing voice chip 146. Voice chip 146 is capable of storing and retrieving voice patterns. Preferably, the voice chip has a read only memory (ROM) in which the voice patterns are stored. The stored patterns may be any desired length, such as 6, 10, 20, or 32 seconds long. Enough pins must be provided to correspond to the output pins of the microcontroller 110. Preferably, the pins are capable of being edge triggered to enunciate a desired speech pattern. The voice chip that is used may be any of the commercially available voice chips that provide the above features, such as the MSS2101/3201 manufactured by Mosel of Taiwan. If the toy permits a user to record his or her own message for later playback by the toy, then a voice recording chip, such as the UM5506 manufactured by United Microelectronic Corp. of Taiwan, or the ISD1110X or ISD1420X both manufactured by information Storage Devices, Inc. of San Jose, Calif., is provided. It will be understood that any other circuit component may additionally or alternatively be contained in voice chip block 36, this block generally representing the action performing block containing the necessary component or device that causes the performance of the desired action. Such other component or device may actuate a motor, external lights that selectively flash, or other desired action performing devices, such as described above.

Voice chip 146 preferably has a ROM with a preloaded series of preferably digitized phrases. However, it will be appreciated that the memory in which the phrases to be played may be located elsewhere. Preferably the phrases are prerecorded audio signals mask programmed onto voice chip 146. Voice chip 146 contains the necessary circuitry to interpret the signal from microcontroller 110 via data bus 144 and to access the appropriate phrase stared within voice chip 146 (or at another memory location) and associated with the signal from microcontroller 110. Furthermore, voice chip 145 preferably also contains the necessary circuitry to convert the recorded phrase into proper audio format for output to speaker 38 (which may or may not be considered a part of voice chip block 36). As known to one of ordinary skill in the art, the signal from voice chip 146 may be amplified as necessary for speaker 38.

During enunciation of the selected speech pattern, voice chip 146 generates a busy signal at busy output pin 148, which signals MCU 24 to enter an idle state in which no further signals are generated by microcontroller 110. The busy signal is turned off at the end of the enunciation, thereby enabling MCU 24 to generate a coded signal that may be transmitted to the corresponding toy to actuate the corresponding toy to perform a corresponding interactive response. Preferably, MCU 24 remains in a ready state, waiting for the termination of the busy signal. Once the busy signal ends, MCU 24 may continue its subroutine, the next set of which is to transmit a coded signal to another toy, as described in greater detail below.

Once microcontroller 110 has generated the signal to transmit to the other toy, microcontroller 110 must transmit the signal to infrared emitting diode 42. The infrared detector/receiver 34 used in each of the control circuits 100 of the interactive toys of the present invention generally can only receive an infrared signal with a predetermined carrier frequency (preferably 38 Khz). Thus, infrared emitting diode 42 must emit a signal at that predetermined frequency as well. Accordingly, circuit 100 is provided with an oscillator 44 which generates a signal at the necessary frequency for detection by another infrared detector/receiver 34.

Theoretically, the diodes of oscillator 44 are not necessary when the circuit is oscillating. They an nonetheless included to prevent the circuit from hanging up and also to allow the circuit to self-start on power-up. Without the diodes, R2 and R3 are returned to VCC (power), and except for the removal of R1 and R4 from the timing equations, the circuit functions in the same manner. However, if both transistors ever go into conduction at the same time long enough so that both capacitors are discharged, the circuit will stay in that state, with base currents being supplied through R2 and R3. With the diodes present, the transistors cannot both be turned on at the same time, since to do so would be to force both collector voltages to zero and there would be no source of base current. Both capacitors will try to charge through the bases, and when one begins to conduct, positive feedback will force the other off, so that the first gains control. The cycle will then proceed normally. It is noted that the value of R2 and R3 must be larger than that of R1 and R4 to prevent the recharge time constant from being unduly long and the rising edges of the output waveforms from being rounded off or otherwise distorted.

Circuit 100 is also provided with an enable/disable control 46. MCU 24 controls enable/disable control 46 to control whether or not the oscillating signal of oscillator 44 may be passed to infrared emitting diode 42. Preferably, the oscillating signal is passed through interconnected transistors as shown. Thus, when MCU 24 is ready to transmit a signal to another toy, MCU 24 emits a serial data stream representing the signal to be transmitted. This signal turns on enable/disable control 46 in the coded sequence to permit oscillator 44 to drive infrared emitting diode 42 in accordance with the serial data stream. As one of ordinary skill in the art would know, the signal from oscillator 44 typically must be amplified, such as by output signal block 150.

The signal from infrared emitting diode 42 is received by an infrared detector/receiver 34 in a corresponding circuit 100 in a corresponding toy provided to interact with the first toy having the above-described circuit. The infrared detector/receiver 34 of the corresponding toy receives and filters the signal from the first actuated toy and sends the signal to the corresponding MCU 24. Such a signal comprises the wireless second signal of the above-mentioned signals that may be received by MCU 24.

Both the hard-wired activation signal from switch connections 32 and the wireless signal received by IR detector 34 are input into microcontroller 110 via different pins, as may be seen in FIG. 3. Thus, microcontroller 110 can differentiate between the signals to determine whether the signal is to cause a reaction-inducing action or a responsive action to be performed. For example, if the signal is from a hard-wired activation signal or from a remote control device, microcontroller 110 must recognize the signal as an initiating signal (i.e., a signal which causes a reaction-inducing action to be performed) to begin an interactive sequence of actions, and thus start the appropriate subroutine. If, however, the signal is from another toy, microcontroller 110 must recognize the signal as a response-inducing signal (i.e., a signal which causes a responsive action to be performed) so that the subroutine for the interactive sequence of actions may be commenced at the appropriate place (rather than at the beginning of the subroutine described below, which would cause a reaction-inducing action to be performed instead).

Figure 5A:
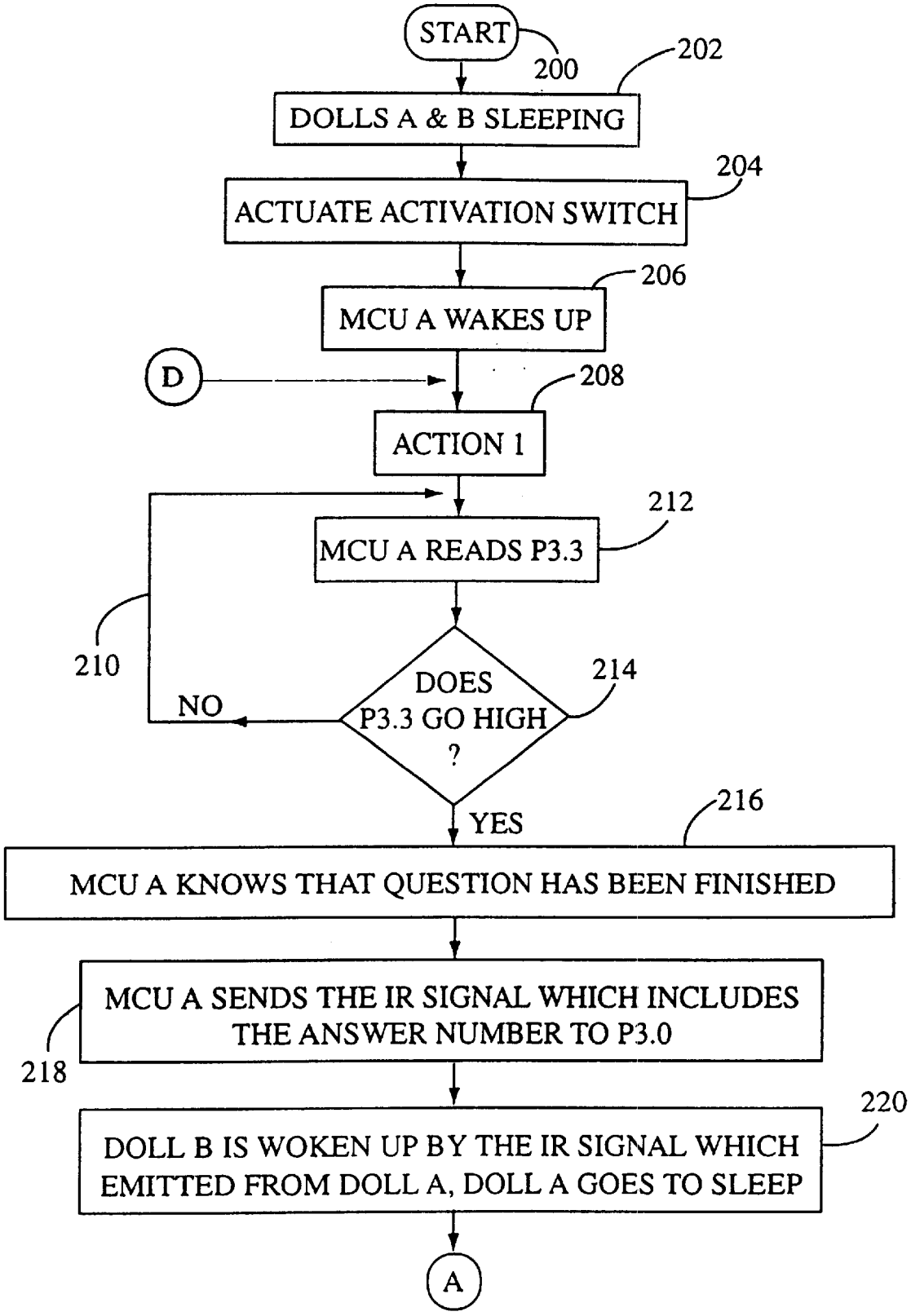
FIGS. 5A–5F are a flow chart showing the sequence of actions performed by toys in the play mode in accordance with the principles of the present invention.
Figure 5B:
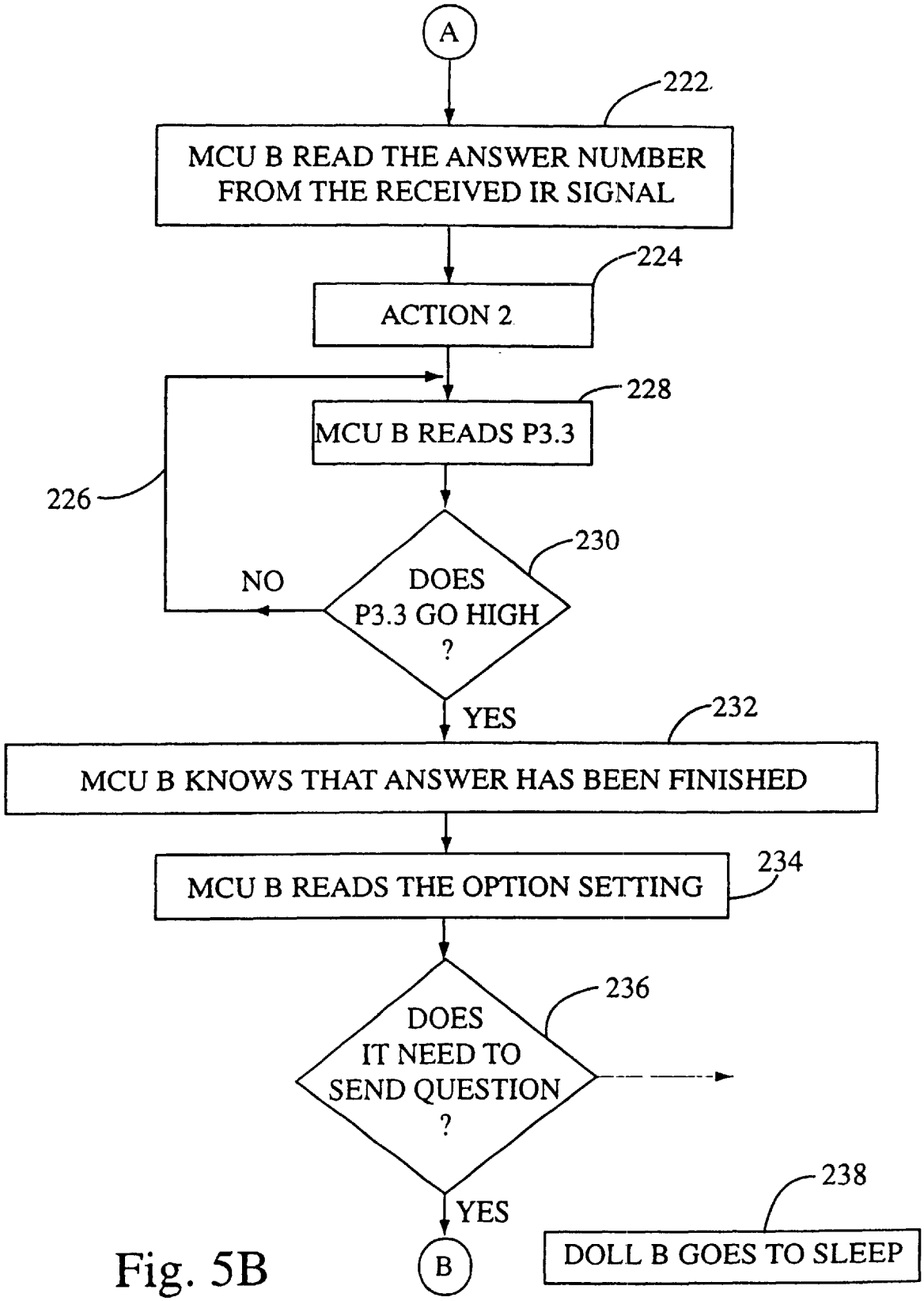
Figure 5C:
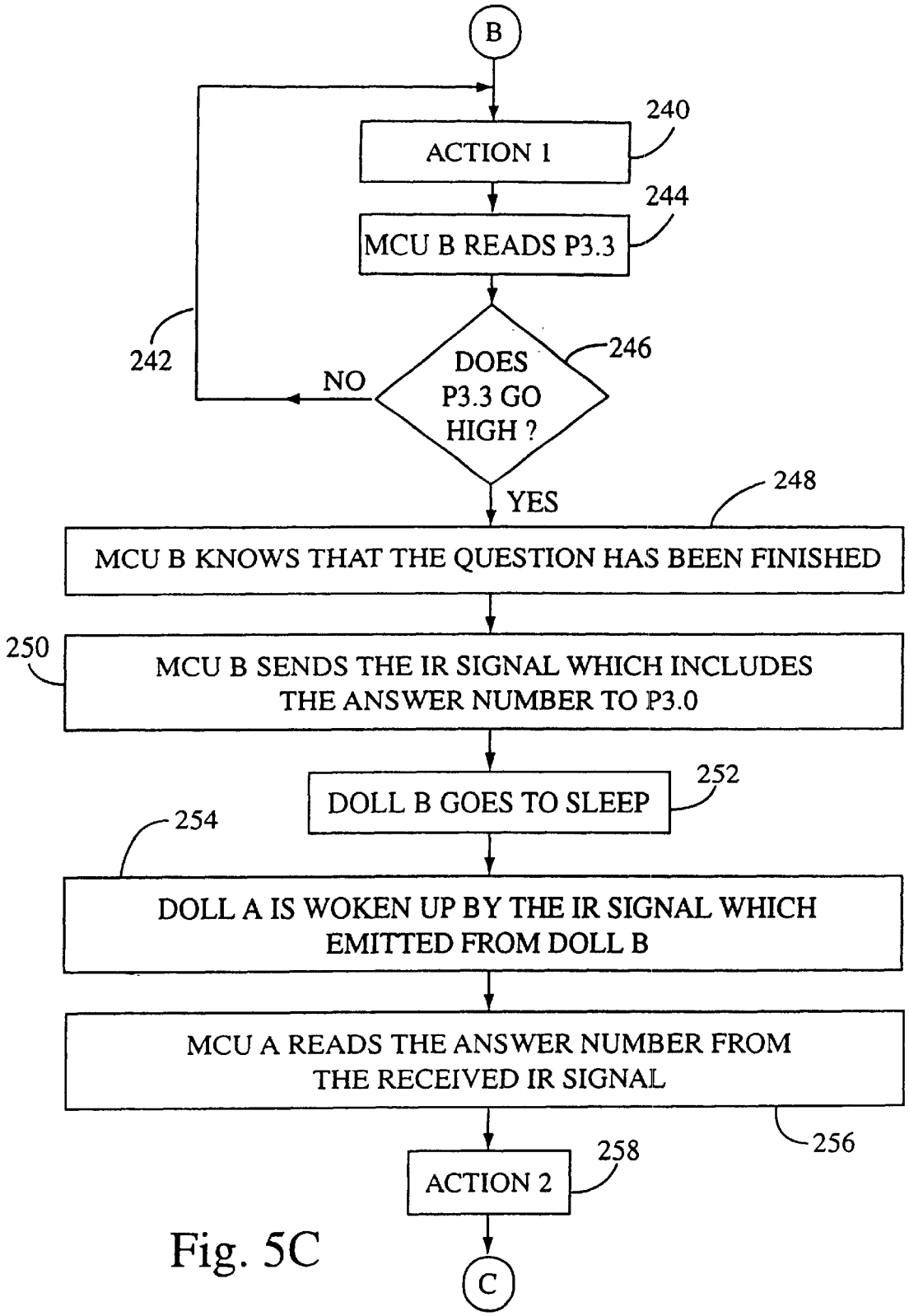
Figure 5D:
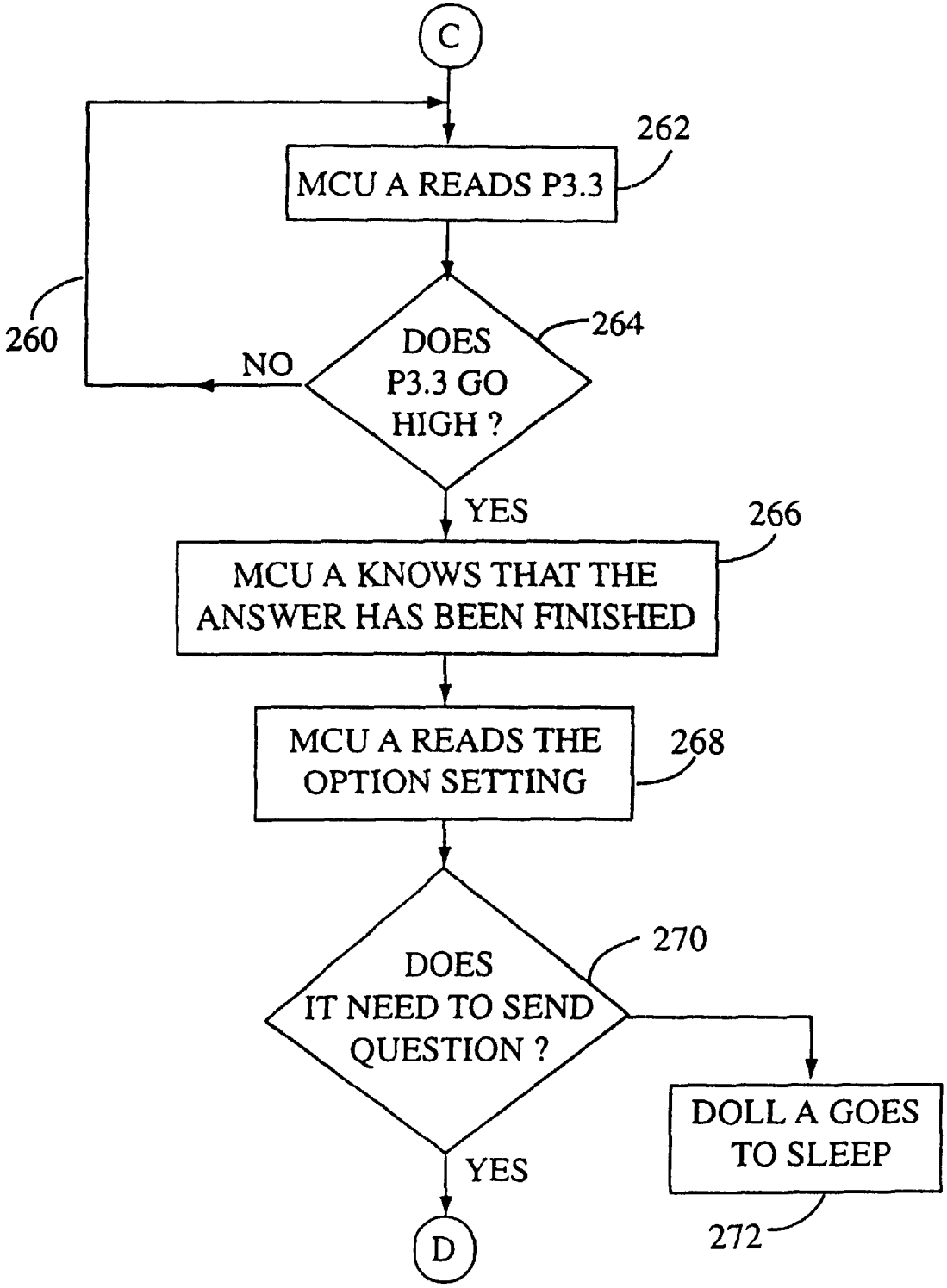
Figure 5E:
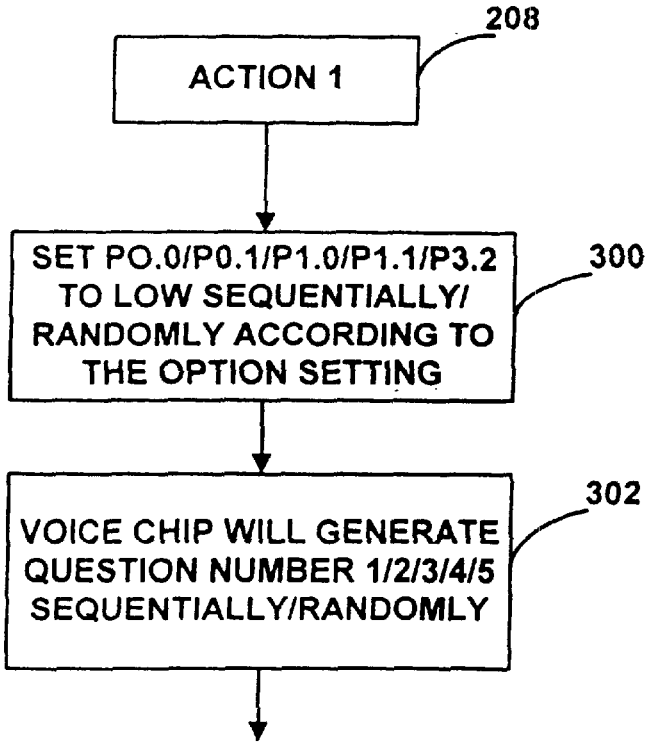

A flow chart of the subroutine for performing an interactive sequence of actions between at least two toys when in play mode (when switch 104 is in play position 108) is shown in FIGS. 5A–5F, beginning with step 200. Dolls A and B are sleeping in step 202. The actuation of the MCU by either a paid-wired activation switch in step 204, causes the MCU of doll A ("MCU A") to wake up in step 206 MCU A then, in step 208, performs Action 1. Action 1 represents a response-inducing action and is represented separately in FIG. 5E because Action 1 represents a sub-subroutine that is performed at various points during the interactive play subroutine of FIGS. 5A–5D. Preferably, Action 1 represents the asking of a response-inducing question by one of the dolls. The software may randomly select (in any desired manner, such as by randomly pointing at a memory location containing an action code or by performing a desired selection computation) one of a plurality of codes associated in the program with different actions to be performed (typically the codes are in a look up table, each code corresponding to a reaction-inducing action or a responsive action) if the set option is in random. Alternatively, if the set option is in sequence, the software sequentially selects an action to be performed, such as by incrementing a variable that causes linear progression through a set of actions that may be performed. Instead, or additionally, a separate switch may be provided corresponding to each question that may be asked. Any desired number of actions may be performed by the dolls. In a preferred embodiment, a total of ten actions may be performed by each doll, five being reaction-inducing actions and the other five being responsive actions. Upon selection, by the software program, of an action to be performed, Action 1 activates the appropriate output pin of the microcontroller corresponding to the selected action code in step 300 (FIG. 5E). As described above, the microcontroller is coupled to the voice chip via an output bus. Thus, the pin of the voice chip corresponding to the activated microcontroller pin is activated, in step 302, to cause the speech pattern associated therewith to be enunciated by the voice chip.

Returning to FIG. 5A, upon performance of Action 1 in step 208, while the voice chip is enunciating the selected speech pattern, MCU A remains in a holding loop 210 waiting for the selected action to be performed so that the next step in the software program may be performed. Specifically, holding loop 210 comprises the steps of reading pin P3.3 of the microcontroller of MCU A in step 212 and asking whether pin P3.3 is high in decision step 214. Pin P3.3 is coupled to the busy signal output of the voice chip and is set low while a busy signal is emitted by the voice chip. Thus, so long as pin P3.3 is low, MCU A continues to read pin P3.3, in step 212, to determine its status. Once the voice chip is finished enunciating the selected speech pattern (as shown, the first action performed is a question, thus, the selected speech pattern is a question) pin P3.3 goes high and MCU A is permitted to continue to step 216, in which MCU A is signaled that the voice chip is finished so that the software program may continue.

Figure 5F:
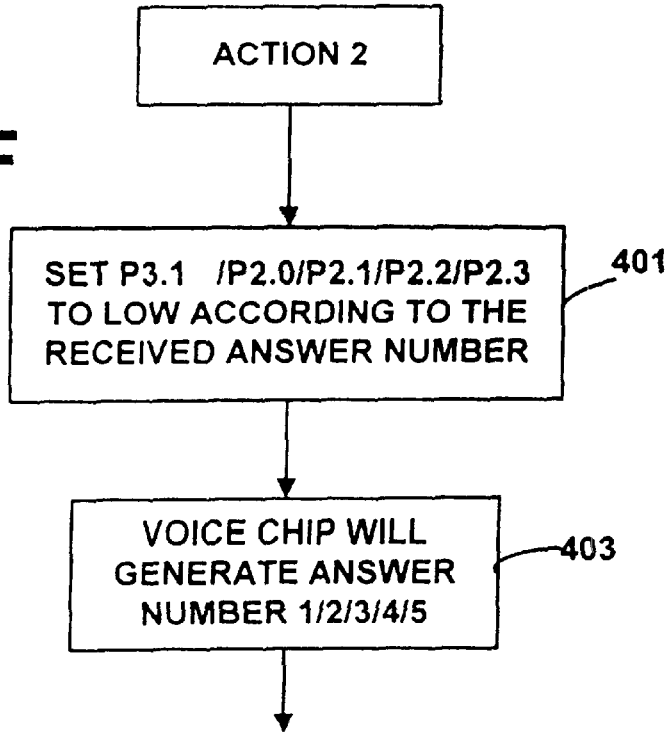

The next step in the software program, or play subroutine, is for MCU A to generate a signal that causes the IR emitter to send a coded signal to the other doll (doll B) in step 218. This signal is coded to represent the appropriate responsive action that is to be performed by doll B. Doll A thus emits a signal that is received by doll B in step 220. The receipt of a signal wakes up doll B, whereas the completion of the performance of an action by doll A permits doll A to return to sleep. MCU B of doll B reads the coded signal emitted from doll A in step 222. Doll B then, in step 224, performs Action 2, shown separately in FIG. 5F. As with Action 1, Action 2 is shown separately because Action 2 represents a sub-subroutine that is performed at various points during the interactive play subroutine of FIGS. 5A–5D. Preferably, Action 2 represents the answering of the question asked by doll A. Typically, a single response is set for each question asked by the first-actuated doll. However, it is within the scope of the present invention to provide several answers to each of the questions asked, each answer either being randomly selected, sequentially selected, or user selected. The software randomly points at, or otherwise randomly selects, one of a plurality of codes (typically in a look up table, each code corresponding to a reaction-inducing action or a responsive action) set by the program if the set option is in random. Alternatively, if the set option is in sequence, the software sequentially causes linear progression (such as by incrementation of a variable) through a set of actions that may be performed. Another option is to permit user selection with either a hard-wired or a remote control unit. Upon selection of the responsive action to be performed by the software program, Action 2 activates the output pin corresponding to the selected action code in step 401 (FIG. 5F). As described above, the MCU is coupled to the voice chip via an output bus. Thus, the pin of the voice chip corresponding to the activated microcontroller pin is also activated, in step 403, to cause the speech pattern associated therewith to be enunciated by the voice chip.

Returning to FIG. 5B, upon performance of Action 2 in step 224, while the voice chip is enunciating the selected speech pattern, MCU B remains in a holding loop 226 waiting for the selected action to be performed so that the next step in the software program may be performed. Specifically, holding loop 226 comprises the steps of reading pin P3.3 of the microcontroller in step 228 and asking whether pin P3.3 is high in decision step 230. Pin P3.3 is coupled to the busy signal output of the voice chip and is set low while a busy signal is emitted by the voice chip. Thus, sa long as pin P3.3 is low, MCU B continues to read pin P3.3, instep 228, to determine its status. Once the voice chip is finished enunciating the selected speech pattern (as shown, the first action performed is a question, thus, the selected speech pattern is a question) pin P3.3 goes high and MCU B is permitted to continue to step 232, in which MCU d is signaled that the voice chip is finished so that the software program may continue.

Because, based on the option set, the answer just enunciated by the voice chip of doll B may or may not be the last action to be performed, the option setting must be read in step 234. In decision step 236, if the option setting is set so that the speech pattern just enunciated is to be the last of the interactive sequence, then doll B goes to sleep again in step 238. However, if greater than one interactive sequence is to be performed by dolls A and B, then doll B performs Action 1 (as shown in FIG. 5E, as described above) to enunciate a question (or other response-inducint action) via the voice chip in step 240. As above, during the enunciation of a speech pattern, MCU B is placed in a holding loop 242, continuously reading pin P3.3 in step 244 to determine, in decision block 246, whether pin P3.3 is high. When MCU B detects that pin P3.3 is high, MCU B determines, in step 248 that the question being enunciated by the voice chip has been finished. As above, the software program of MCU B remains on hold, which pin P3.3 is low, only continuing once pin P3.3 in high so that step 248 may be reached. The software program of MCU B continues with step 250, in which MCU B sends a coded signal to the IR emitter to thereby send a coded signal to doll A. Doll B then goes to sleep in step 252. Doll A, upon receipt of the coded signal emitted by doll B, is woken up in step 254. MCU A then reads, in step 256, the coded signal to determine which answer should be enunciated in response to the question enunciated by doll B, and performs Action 2 in step 258 (represented in FIG. 5F), such as described above with respect to doll B and step 224. Also as described above, while the voice chip is enunciating the selected answer, MCU A is held in holding loop 260 in which MCU A continuously reads pin P3.3 in step 262 and asks, in decision block 264, whether pin 3,3 is high yet. Once pin P3.3 is high, MCU A detects, in step 266, that the voice chip is finished enunciating the answer. MCU A then reads the option setting in step 268, to determine, in decision block 270, whether another interactive sequence of actions is to be performed. If not, doll A goes to sleep in step 272. If so, then the software program returns to point D in FIG. 5A. This process continues until the number of interactive sequences of actions required by the options setting has been performed.

It will be understood that the MCUs must be capable of recognizing whether a signal is from a hard-wired activation switch, which would start the beginning of an interactive sequence of actions, or from a remote control device, which would also start the beginning of an interactive sequence of actions (but correlates the signal differently, as described below), or from another doll, which would cause the doll to perform at least a responsive action (if not another reaction-inducing action as well). It will further be understood that the above-described software program related to the interaction between dolls is only exemplary. The program may be modified, as required, to correspond to other types of interactive sequences of actions performed in accordance with the broad principles of the present invention.

The final of the above-mentioned three signals that activates MCU 24 is a signal from mode selection 28 chat mode selection switch 104 is in the learn position 106. When mode selection switch is moved to the learn position 106, MCU 24 is placed in learn mode and voice chip 36 is turned off. When in learn mode, a learn subroutine is commenced so that MCU 24 may be programmed to interpret an infrared signal generated from a common household remote control unit, such as a commercially available television remote control unit, and respond thereafter to such a signal by performing a desired action as described above. Preferably, several programming buttons are used, each of the selected programming buttons on the remote control device being associated with a single speech pattern by the software program of MCU 24. Additionally, another button permits MCU selection (as 232, opposed to user selection) of an action to be performed, depending on the setting of options setting 26. Thus, a button is associated with a random number generator, or any other software provision that selects a random code such that a randomly selected action is performed if the setting is in random. If, instead, the setting is in linear, then the button is associated with an appropriate software provision for linear selection of an action from the sequence of actions that may be performed. MCU 24 is capable of emitting a signal, such as a beep via speaker 38, in order to indicate whether or not the infrared signal of the selected button has been associated with the code that initiates the desired action of the interaction sequence. Once MCU 24 has been programmed, an infrared signal generated by the remote control device and received by the infrared detector/receiver 34 may be processed in substantially the same manner as a hard-wired activation signal, substantially as described above. However, it will be understood that because each remote control unit is different, each time the toys are programmed the particular coded signals associated with the remote control used must be associated with the code set for the action (a set code) and stored in the program. Thus, upon remote control actuation, above-described Action 1 or 2 involves identifying the received signal through the use of a different look up table (or other form in which codes are stored and correlated) than that which is preprogrammed for hard-wired actuation.

Figure 6:
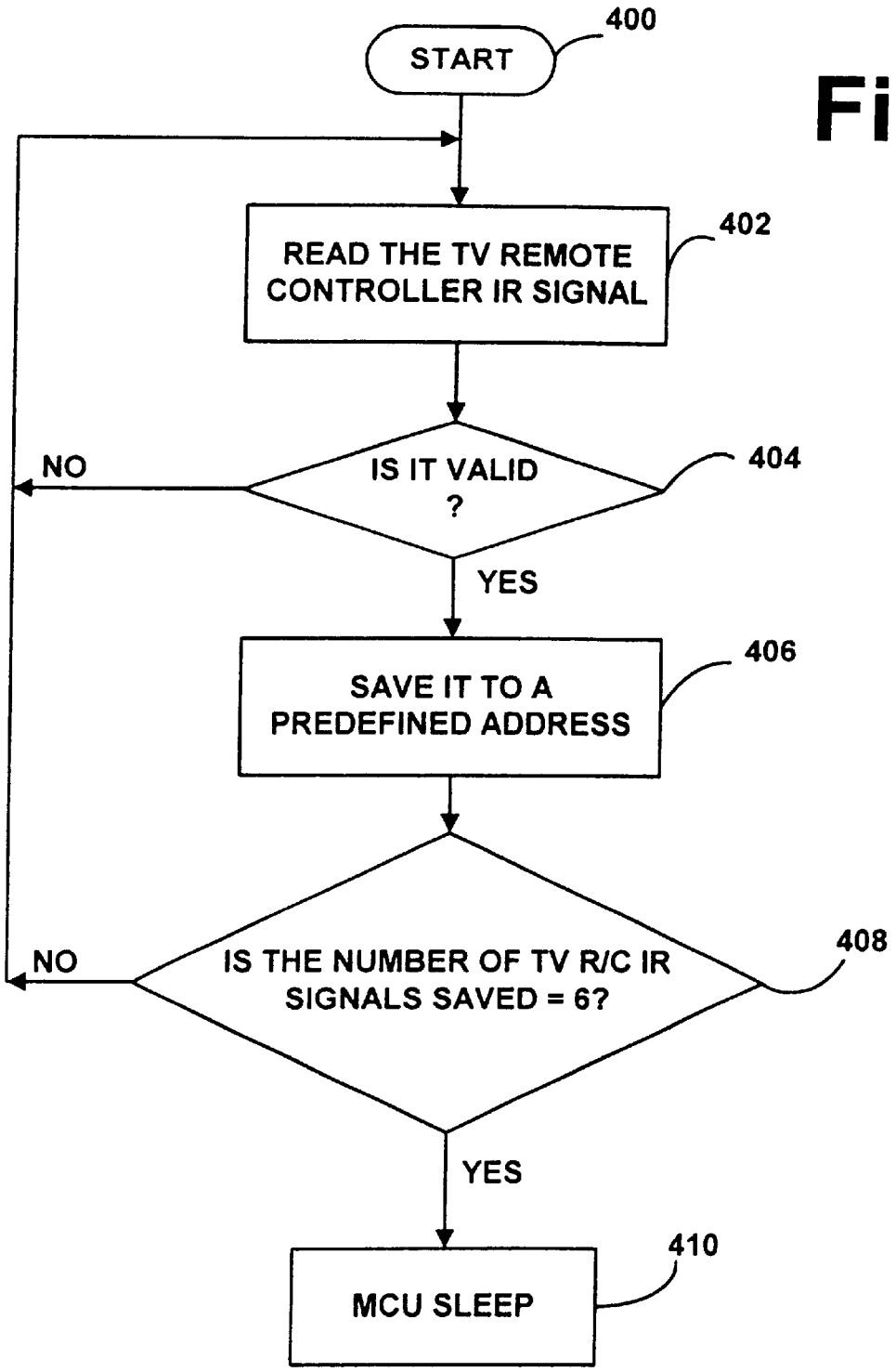
FIG. 6 is a flow chart showing the sequence of actions performed by toys in the learn mode in accordance with the principles of the present invention.

The learn subroutine, implemented when MCU 24 is in learn mode so that a received infrared (or other wireless) signal from a wireless control device may be associated with a code for a desired action to be performed, will now be described with reference to FIG. 6. The number of buttons on the remote control device preferably corresponds to the number of actions the toy can perform, plus an additional button that corresponds to the hard-wired activation signal. Like the hard-wired activation signal, the additional button selects an action either randomly or in accordance with a preset sequence, depending on the doll's setting. Preferably six buttons are used for programming one doll and a different six buttons are used for programming the other doll. In step 400 of the learn subroutine shown in FIG. 6, the learn software subroutine is started. The user points a remote control first at one doll and then at the other doll and sequentially presses the number of remote control buttons necessary to correlate with each action to be performed so that the dolls can be programmed to respond differently to the pressing of each of the buttons. Thus, the buttons used for one doll are different from the buttons used for the other doll. Each time a user presses a button of the remote control unit, the MCU of the doll being programmed reads the signal in step 402. Before continuing, the MCU must determine, in decision step 404, whether the received signal is valid (recognizable by the MCU). If not, the MCU learn subroutine returns to step 404 to read another signal. If the signal, however, is valid, then the subroutine continues with step 406, in which the read signal is saved in a predefined address (associated with one of the possible actions) in the program for later use. After saving the signal, decision block 408 determines whether all coding buttons have been programmed. If not, the subroutine returns to step 402 to read another signal from the remote control. Once all of the buttons have been programmed, there are no more addresses to be assigned with a coded signal and the subroutine continues with step 410, in which the MCU rests until activated by one of the above-described actuation signals. It will be appreciated that fewer or greater than six buttons may be programmed, depending on the number of actions that may be performed.

It will be understood that although such programming capability as described is provided in a preferred embodiment of the invention, such feature is not necessary to achieve the broad objects of the present invention. Such programming capability requires the above-described MCU. If such capability is not desired, and only one interactive action sequence is performed by the toys, then an MCU is unnecessary.

While the foregoing description and drawings represent the preferred embodiments of the present invention, it will be understood that various additions, modifications and substitutions may be made therein without departing from the spirit and scope of the present invention as defined in the accompanying claims. In particular, it will be understood that although much of the above disclosure is dedicated to describing the principles of the present invention as applied to two interactive dolls, these principles may be equally applied to other interactive toys as well. It will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. An interactive device having an interactive subsystem comprising:

at least one play-mode subsystem operative to perform at least one predetermined instruction generated by at least one other interactive device; and at least one ultrasound communication subsystem operative to communicate with said other interactive device and to relay said predetermined instruction received from said other interactive device to said play-mode subsystem, the communication subsystem comprising:

an ultrasound detector subsystem operative to detect am ultrasound signal; and an ultrasound transmitter subsystem operative to transmit an ultrasound signal;

said ultrasound communication subsystem being operative to communicate to the form of at least one of a transmission and a reception of said ultrasound signal.

2. The interactive device of claim 1 wherein said ultrasound transmitter subsystem comprises:

a frequency oscillator generator subsystem operative to generate said ultrasound signal;

an ultrasound emitter driver subsystem operative to emit said generated ultrasound signal to at least one other ultrasound detector subsystem; and at least one output disable/enable control subsystem operative to control the relay of said generated ultrasound signal from said generator subsystem to said emitter driver subsystem.

3. The interactive device of claim 1 wherein said interactive subsystem further comprises:

an activation subsystem operative to activate said play-mode subsystem;

an options-setting subsystem operative to determine at least one of an operational duration of the interactive subsystem and a performance order when a plurality of predetermined instructions are received by said play-mode subsystem; and a micro-controller subsystem operative to execute operations of said play-mode subsystem upon activation of said activation subsystem;

wherein at least one of said operational duration and said performance order to be executed by said micro-controller subsystem is based on said determination of said options-setting subsystem.

4. The interactive device of claim 3 wherein said activation subsystem comprises:

a mode selection subsystem operative to determine whether said play-mode subsystem is active;

the activation subsystem being operative to activate said play-mode subsystem based on said predetermined instruction received from said external source upon a determination by said mode selection subsystem that said play-mode subsystem is active.

5. The interactive device of claim 4 wherein said communication subsystem relays said predetermined instruction received from said external source to said activation subsystem.

6. The interactive device of claim 3 wherein said performance order is a random performance order.

7. The interactive device of claim 3 wherein said performance order is a sequential performance order.

8. The interactive device of claim 3 wherein said performance order is a combination of a random performance order and a sequential performance order.

9. The interactive device of claim 3 wherein said communication subsystem relays said predetermined instruction received from said external source to said options-setting subsystem.

10. The interactive device of claim 3 wherein said interactive subsystem further comprises:

a recordable memory medium having a predetermined instruction stored thereon; and a data-input subsystem which is operative to provide said play-mode subsystem with said predetermined instruction from said recordable memory medium.

11. The interactive device of claim 10 wherein said recordable memory medium is at least one recordable integrated circuit chip.

12. The interactive device of claim 10 further comprising an external recording device to record said predetermined instruction.

13. The interactive device of claim 12, wherein said external recording device is a microphone.

14. The interactive device of claim 10 wherein said predetermined instruction is at least one data-file and at least one instruction for storage of said data-file in said recordable memory medium for subsequent retrieval by said data-input subsystem and operational execution of said play-mode subsystem by said micro-controller subsystem.

15. An interactive device having an interactive subsystem comprising:

at least one programmable learn-mode subsystem operative to receive at least one predetermined instruction;

at least one recordable memory medium having at least one pre-stored instruction stored therein;

at least one play-mode subsystem operative to perform at least one instruction wherein said instruction is at least one of said predetermined instruction relayed from said programmable learn-mode subsystem and said pre-stored instruction relayed from said memory medium; and a communication subsystem operative to communicate with an external source and comprising:

an ultrasound detector subsystem operative to detect an ultrasound signal; and an ultrasound transmitter subsystem operative to transmit an ultrasound signal;

said communication subsystem being operative to communicate in the form of at least one of a transmission and a reception of said ultrasound signal.

16. The interactive device of claim 15 wherein said learn-mode subsystem comprises:

a programmable options-setting subsystem operative to determine at least one of an operational duration of the interactive subsystem and a performance order when a plurality of predetermined instructions are received by said learn-mode subsystem.

17. The interactive device of claim 16 wherein said interactive subsystem further comprises:

an activation subsystem operative to determine activation of at least one of said play-mode and said learn-mode subsystems;

a data-input subsystem operative to provide said play-mode subsystem with said pre-stared instruction; and a micro-controller subsystem operative to execute operations of at least one of said play-mode and said learn-mode subsystems based on said determination of said activation subsystem;

wherein at least one of said operational duration and said performance order to be executed by said micro-controller subsystem is based on said determination of said options-setting subsystem.

18. The interactive device of claim 17 wherein said pre-stored instruction is retrieved by said data-input subsystem from said recordable memory medium.

19. The interactive device of claim 18 wherein said recordable memory medium is at least one recordable integrated circuit chip.

20. The interactive device of claim 18 further comprising an external recording device to record said pre-stored instruction.

21. The interactive device of claim 20 wherein said external recording device is a microphone.

22. The interactive device of claim 18 wherein said predetermined instruction is at least one data-file for subsequent execution by said play-mode subsystem.

23. The interactive device of claim 18 wherein said predetermined instruction is at least one data-file and at least one instruction for storage of said data-file in said recordable memory medium for subsequent retrieval by said data-input subsystem and operational execution of said play-mode subsystem by said micro-controller subsystem.

24. The interactive device of claim 17 wherein said activation subsystem comprises:

a mode-selection subsystem operative to determine which of at least one of said play-mode and said learn-mode subsystems is active;

said activation subsystem being operative to activate said play-mode subsystem based on a predetermined instruction received from at least one of an external source and an external activation switch, and to activate said learn-mode subsystem based on a predetermined instruction received from said mode-selection subsystem.

25. The interactive device of claim 24 a wherein said communication subsystem relays said predetermined instruction received from said external source to said activation subsystem.

26. The interactive device of claim 16 wherein said performance order is a random performance order.

27. The interactive device of claim 16 wherein said performance order is a sequential performance order.

28. The interactive device of claim 16 wherein said performance order is a combination of a random performance order and a sequential performance order.

29. The interactive device of claim 16 wherein said communication subsystem relays said predetermined instruction received from said external source to said programmable options-setting subsystem.

30. The interactive device of claim 29 wherein said relayed predetermined instruction is an instruction to modify said determination of said programmable options-setting subsystem.

31. The interactive device of claim 29 wherein said relayed predetermined instruction is an instruction to modify at least one operative parameter of said programmable options-setting subsystem.

32. The interactive device of claim 15 wherein said external source comprises another interactive device.

33. The interactive device of claim 15 wherein said ultrasound transmitter subsystem comprises:

a frequently oscillator generator subsystem operative to generate said ultrasound signal;

an ultrasound emitter driver subsystem operative to emit said generated ultrasound signal to at least one other ultrasound detector subsystem; and an output disable/enable control subsystem operative to control the relay of said generated ultrasound signal from said generator subsystem to said emitter driver subsystem.

34. An entertainment system comprising at least two interactive devices, each of the interactive devices having an interactive subsystem comprising:

at least one play-mode subsystem operative to perform at least one predetermined instruction generated by at least one external source; and at least one ultrasound communication subsystem operative to communicate with said external source and to relay said predetermined instruction received from said external source to said play-mode subsystem, the ultrasound communication subsystem comprising:

an ultrasound detector subsystem operative to detect an ultrasound signal; and an ultrasound transmitter subsystem operative to transmit an ultrasound signal;

said ultrasound communication subsystem being operative to communicate in the form of at least one of a transmission and reception of said ultrasound signal.

35. The system of claim 34, wherein said external source is another interactive device.

* * * * *